United States Patent [19]

Work

[11] 4,249,289

[45] Feb. 10, 1981

[54] COMBINATION BURIAL VAULT AND CASKET AND FUNERAL AND BURIAL METHOD OR SYSTEM EMPLOYING THE SAME

[75] Inventor: Gerald L. Work, Spokane, Wash.

[73] Assignee: Wilbert, Inc., Forest Park, Ill.

[21] Appl. No.: 109,346

[22] Filed: Jan. 3, 1980

[51] Int. Cl.[3] ..... A61G 17/00

[52] U.S. Cl. ..... 27/35

[58] Field of Search ..... 27/2–7, 27/35

[56] References Cited

U.S. PATENT DOCUMENTS

| | | | |
|---|---|---|---|
| 2,916,797 | 12/1959 | McCombs | 27/35 |
| 3,208,186 | 9/1965 | Fulton et al. | 27/35 X |
| 3,295,179 | 1/1967 | Behrendt | 27/35 |
| 3,868,799 | 3/1975 | Hayward | 27/2 |
| 4,139,929 | 2/1979 | Angerman | 57/35 |

*Primary Examiner*—John D. Yasko

*Attorney, Agent, or Firm*—Charles B. Cannon

[57] ABSTRACT

A combination burial vault and casket and funeral and burial method or system are provided. The burial vault comprises a base which includes a generally rectangular-shaped upright interiorly decorated inner wall structure having a closed bottom and an open top. A "surround" or false casket includes a generally rectangular-shaped box-like frame having handle members attached thereto, and having an open top and an open bottom and an interiorly decorated hinged top or closure member. In use the "surround" or false casket is arranged over and encloses the inner upright wall structure and bottom wall or supporting platform of the base and is releasably latched thereto at the funeral home with the remains of the deceased arranged in the casket assembly provided by the inner upright wall structure and its bottom wall or supporting platform and the "surround" or false casket enclosing the same. After the funeral service at the funeral home the "surround" or false cakset is unlatched from the inner upright wall structure and its bottom wall or supporting platform and is retained at the funeral home for reuse. The inner upright wall structure is then hermetically sealed and a dome-shaped cover member is arranged over and hermetically sealed and mechanically fastened to the inner upright wall structure and the bottom wall or supporting platform of the base of the vault at the funeral home. The thus assembled and hermetically sealed vault, with the remains of the deceased therein, is then transported from the funeral home to the cemetery for a graveside or other cemetery service, and for interment in the grave opening.

22 Claims, 17 Drawing Figures

COMBINATION BURIAL VAULT AND CASKET AND FUNERAL AND BURIAL METHOD OR SYSTEM EMPLOYING THE SAME

BACKGROUND OF THE INVENTION

Attempts have been made heretofore to provide combination burial vaults and caskets and funeral and burial methods or systems which include the reuse of certain components thereof, but such attempts have thus far had limited, if any success. Among such other prior attempts has been the use of cardboard boxes and the burial apparatus and methods or systems disclosed in prior art U.S. Pat. Nos. 1,410,643, 1,883,600, 1,912,790, 2,508,319, 2,848,780, 2,882,584, 2,916,797, 3,127,183 and 3,844,003. However, the combination burial vaults and caskets and funeral and burial vault methods or systems employing the same in the prior art, including those disclosed in the abovementioned patents, have met with limited, if any, success, due to many causes, including impracticality, cost, lack of proper aesthetic appearance and appeal, inability to conform to the traditional dignity of the funeral service at the funeral home and at the cemetery, and for other reasons.

OBJECTS OF THE INVENTION

An object of the present invention is: (1) to provide a novel combination burial vault and casket and a novel funeral and burial method or system employing the same which has, among others, the following advantages and characteristics, namely, (a) it retains the traditional dignity and aesthetic appeal of the funeral service during visitation and the funeral service at the funeral home and at the cemetery; (2) provides a combination burial vault and casket and funeral and burial method or system employing the same which is novel, practical, relatively inexpensive and in which a generally rectangular-shaped open and interiorly decorated frame of an inner wall structure which forms a component part of the base of the burial vault, and a generally flat supporting platform therefor, which forms the bottom wall of the inner wall structure, cooperate with the handle-bearing frame and the interiorly decorated hinged top or closure member of a "surround" or false casket arranged thereover to provide a display casket assembly during visitation and the funeral service at the funeral home.

Another object of the invention is to provide a novel combination burial vault and casket and a novel funeral and burial method or system in which, after the close of visitation and the funeral services in the funeral home, the handle-bearing frame of the "surround" or false casket is removed from the inner wall structure of the base of the vault and left at the funeral home for reuse, whereupon a generally flat closure or lid member is arranged over and hermetically sealed to the inner wall structure of the base of the vault, with the remains of the deceased enclosed therein, and a dome-shaped cover member of the base of the vault is arranged over the thus sealed inner wall structure of the base of the vault and is hermetically sealed to and mechanically fastened to the inner wall structure of the base at the funeral home to complete the assembly of the burial vault which is then transported to the cemetery for a graveside or other cemetery service.

An additional object of the invention is to provide a novel means and construction for releasably latching the "surround" or false casket to the inner wall structure of the base of the vault and to the bottom wall or supporting platform therefor at the funeral home during visitation and the funeral service at the funeral home and so that, if necessary, the "surround" or false casket and the inner wall structure of the base of the vault, and its bottom wall or supporting platform, thus latched together, may be moved in and about the funeral home or like place.

Another object of the invention, ancellary to the object set forth immediately above, is to provide a novel latching means for releasably latching the "surround" or false casket over and to the inner wall structure of the base of the vault and its bottom or supporting platform so that the "surround" or false casket may be readily unlatched from the base of the vault and its bottom wall or supporting platform and retained at the funeral home for reuse after the close of the visitation and the funeral service at the funeral home.

Another object of the invention is to provide a novel combination burial vault and casket and a novel funeral and burial method or system which employs the burial vault which forms the subject matter of and is disclosed and claimed in applicant's co-pending application, Ser. No. 097,716, filed Nov. 27, 1979, entitled "Burial Vaults", and which will be described hereinafter.

A further object of the invention is to provide a new and improved combination burial vault and casket and a novel funeral and burial method or system in which component parts of the base of the burial vault cooperate with a reusable "surround" or false casket to provide a simulated casket or casket assembly in which the remains of the deceased may be viewed during visitation at the funeral home so that the family of the deceased is saved the expense of buying both a casket, per se, and a burial vault since the family need purchase only the burial vault and pay for the use of the reusable "surround" or false casket and for the funeral services and rental of the funeral home and related expenses.

Other objects will appear hereinafter.

DESCRIPTION OF FIGURES IN THE DRAWINGS

Figure 1:
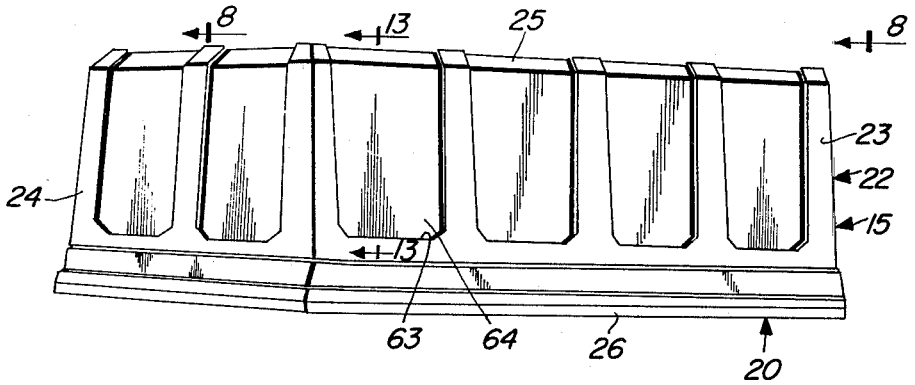
FIG. 1 is a perspective view of the burial vault which is embodied and used in the present invention with the component parts thereof in assembled position.
Figure 3:
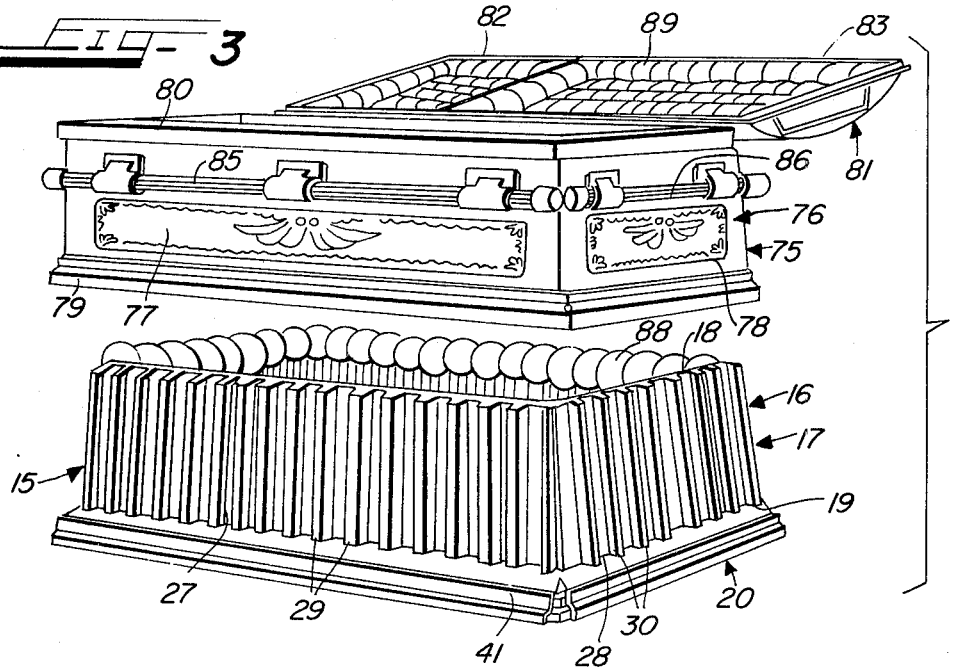
Figure 5:
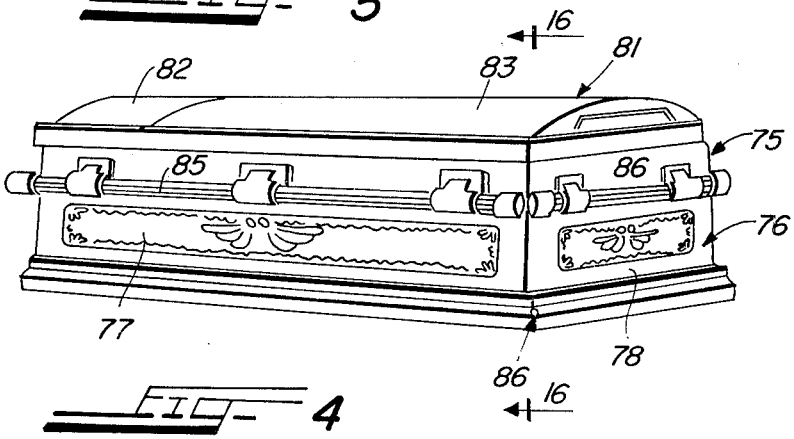
Figure 4:
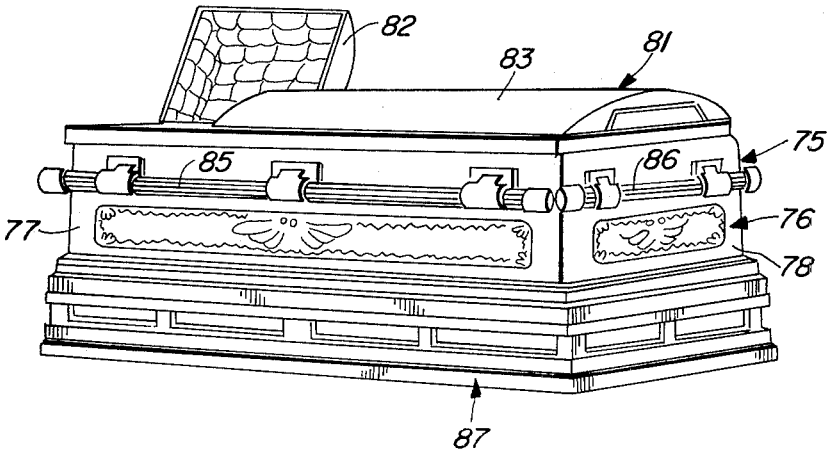
Figure 6:
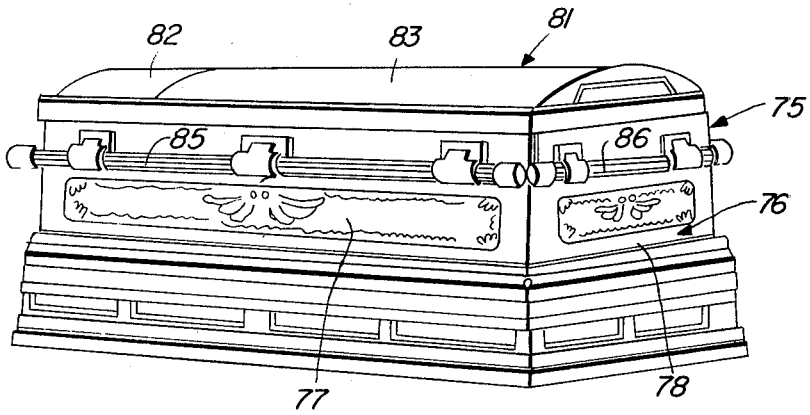
Figure 7:
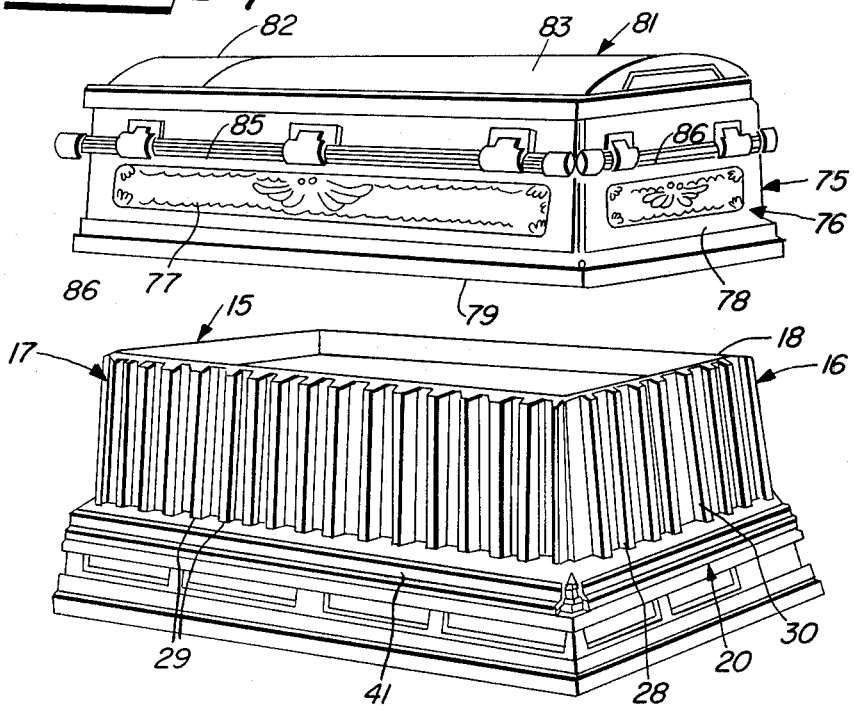
Figure 8:
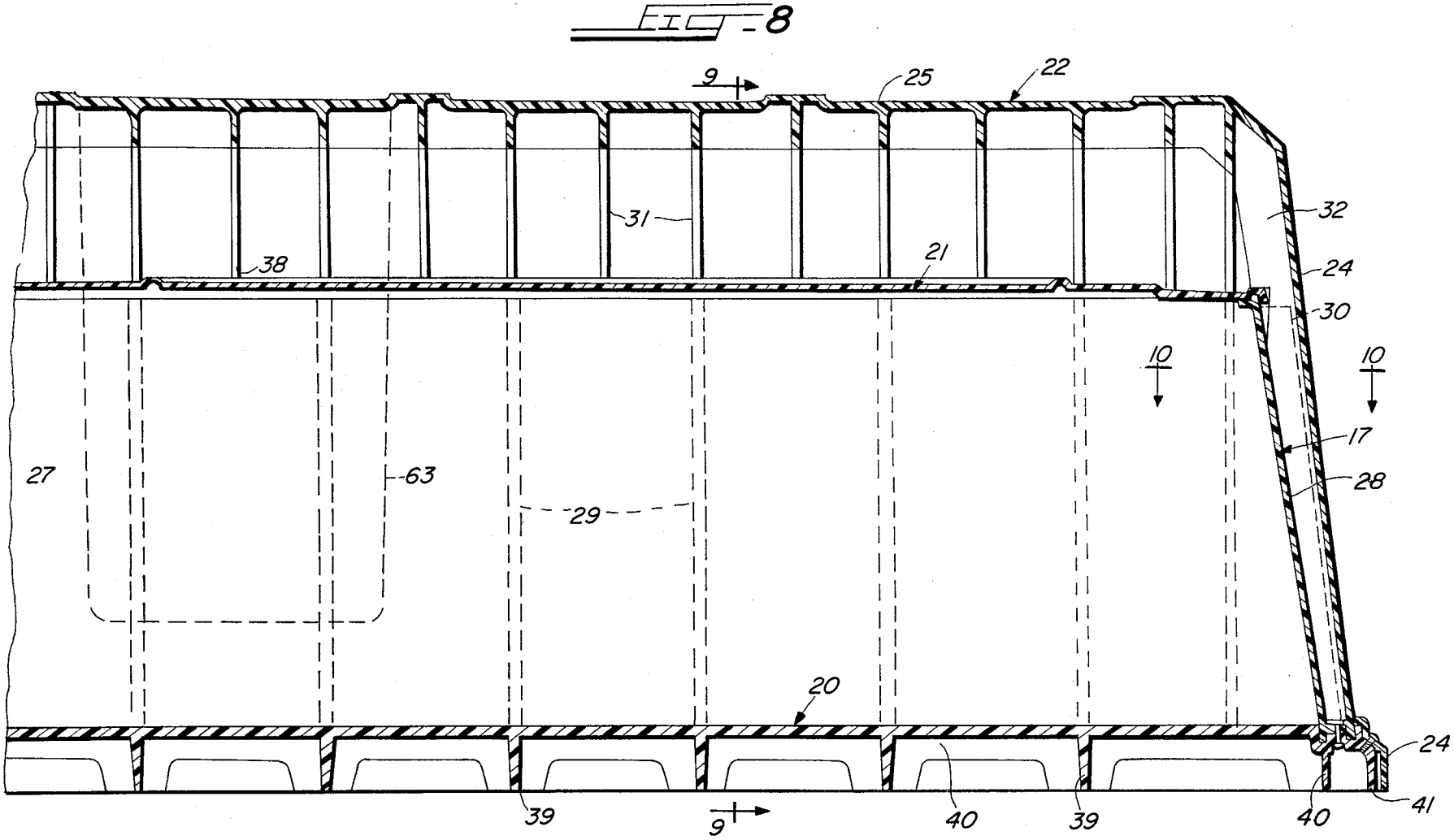
Figure 9:
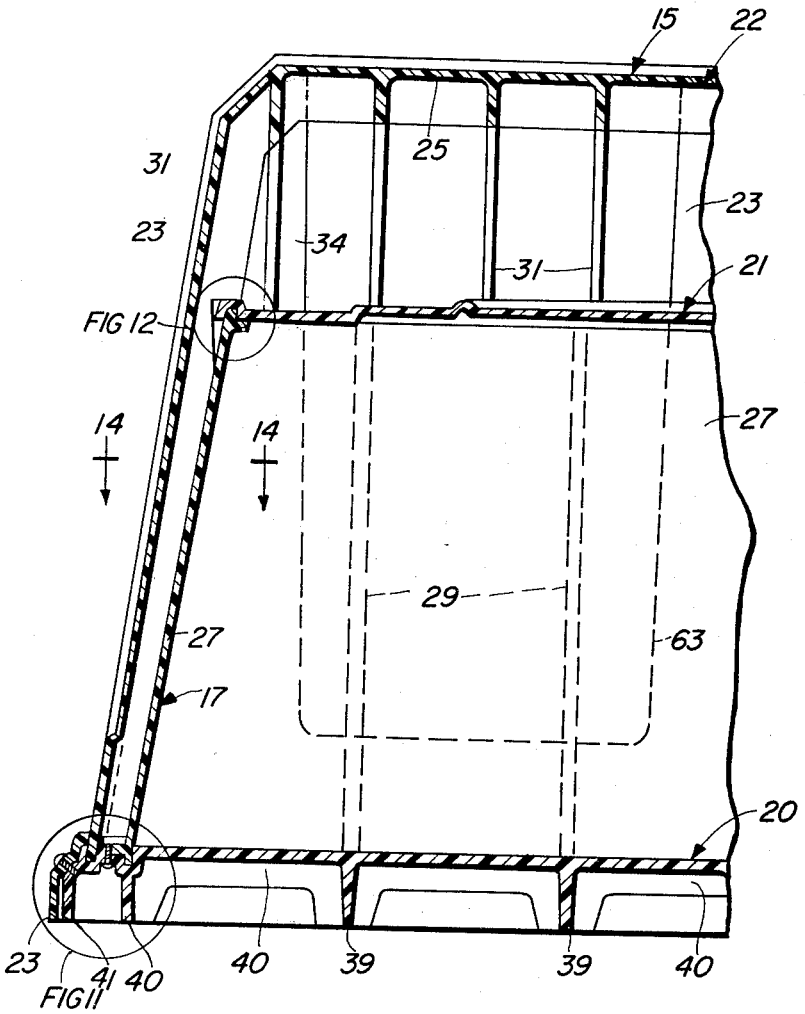
Figure 10:
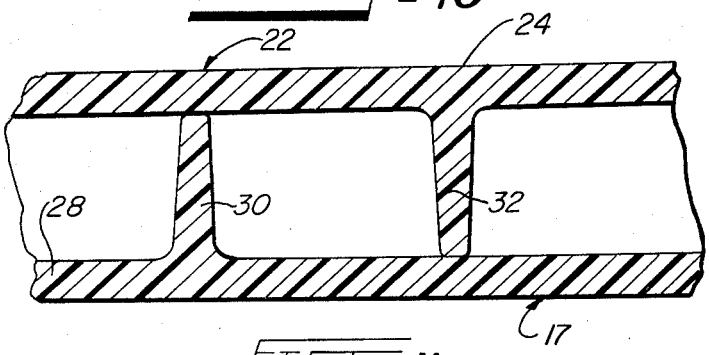
Figure 11:
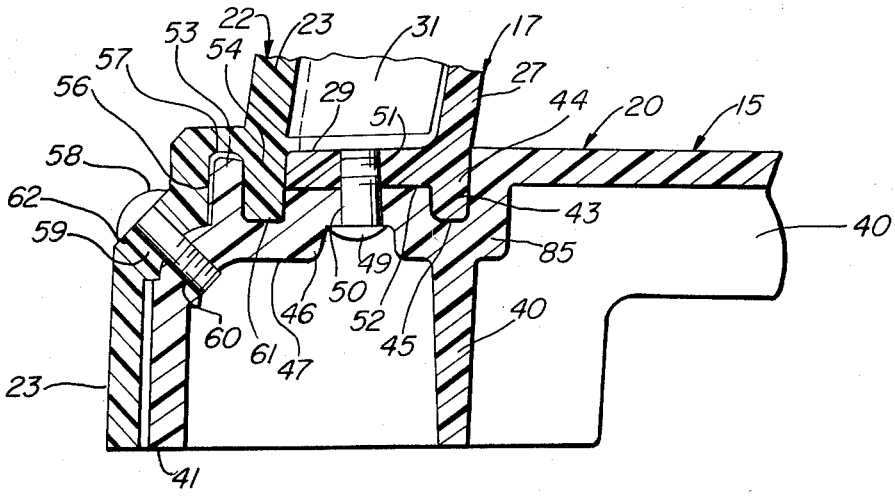
Figure 13:
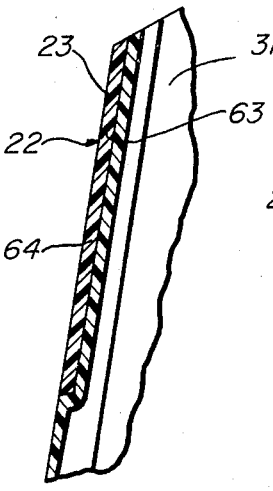
Figure 12:
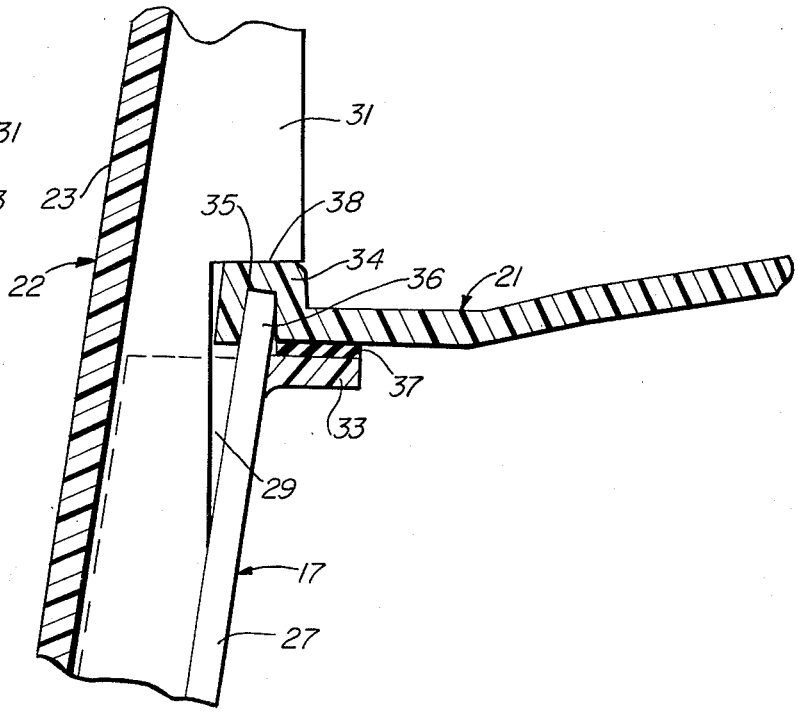
Figure 16:
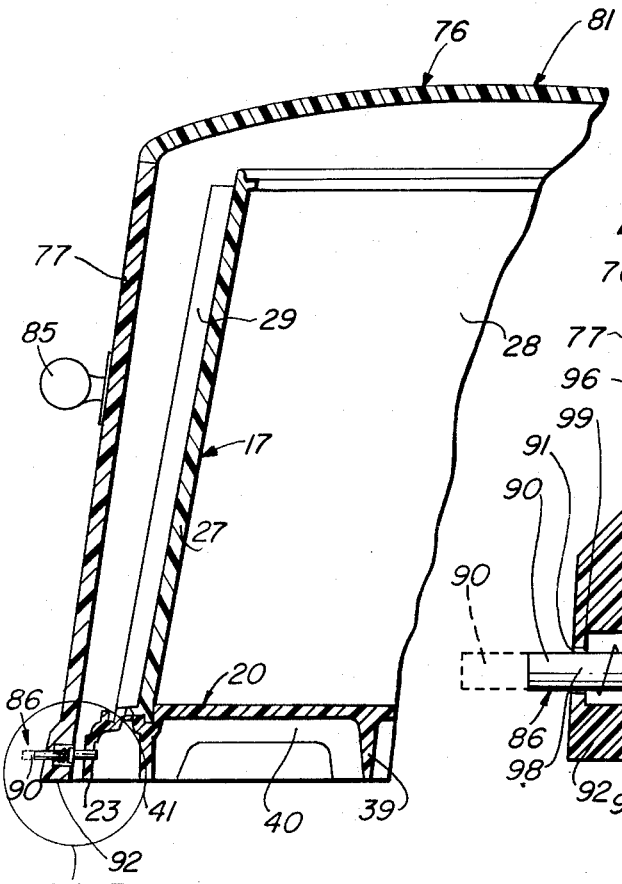
Figure 17:
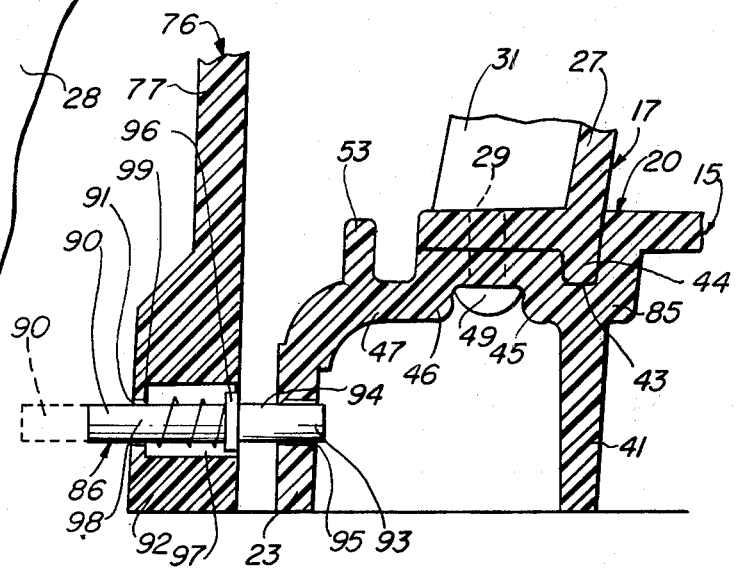
Figure 15:
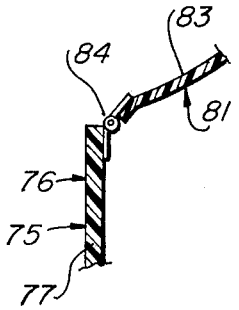
Figure 14:
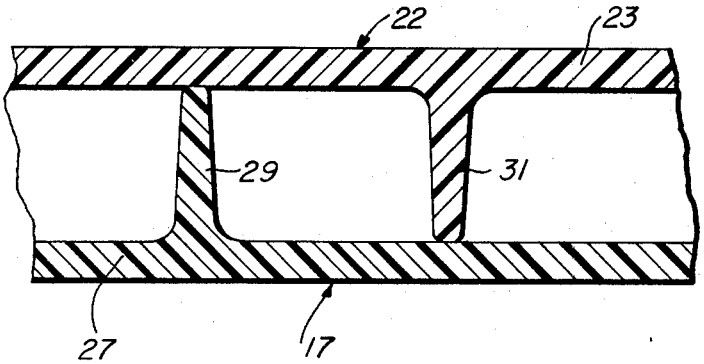

FIG. 3 is an exploded perspective view illustrating the generally flat rectangular-shaped supporting platform or bottom wall of the base of the vault and the interiorly decorated generally rectangular-shaped open frame of the inner upright wall structure of the base of the vault resting on the supporting platform or bottom wall of the base of the vault and with the handlebearing "surround" or false casket disposed thereabove and in position to be assembled at the funeral home with, and arranged over, the interiorly decorated frame of the inner wall structure of the base of the vault;

FIG. 4 is a perspective view showing the parts illustrated in FIG. 3 assembled for viewing at the funeral home, and resting on a conventional supporting frame, and showing the head section of the hinged top or closure member of the "surround" or false casket in open position for viewing and during visitation at the funeral home;

FIG. 5 is a perspective view of the components of the base of the vault and the "surround" or false casket, as shown in FIG. 4, in assembled position, with the hinged top or closure member of the "surround" or false casket closed at the close of visitation and the funeral service at the funeral home;

FIG. 6 is a perspective view illustrating the assembly of the parts, as shown in FIG. 5, at the funeral home after the close of visitation and the funeral service at the funeral home;

FIG. 7 is an exploded perspective view of the assembly shown in FIG. 6 but showing the "surround" or false casket unlatched and removed from the generally rectangular-shaped open frame of the inner upright wall structure and supporting platform or bottom wall of the base of the vault with the handle-bearing "surround" or false casket to be retained at the funeral home for reuse;

FIG. 8 is an enlarged fragmentary transverse vertical sectional view, on line 9—9 in FIG. 8, showing certain of the component parts of the burial vault in assembled position;

FIG. 10 is an enlarged sectional detail view, on line 10—10 in FIG. 8, illustrating the arrangement of the reinforcing ribs on the outer surface of the end walls of the generally rectangular-shaped frame of the inner upright wall structure of the base and the reinforcing ribs on the inner surface of the end walls of the dome-shaped outer cover member of the vault;

FIG. 11 is an enlarged fragmentary sectional detail view of the area encircled in FIG. 9, illustrating the means or construction for hermetically sealing and mechanically fastening the dome-shaped outer cover member of the vault to the supporting platform which forms the bottom wall of the base of the vault, and also showing the means or construction for hermetically sealing and mechanically fastening the generally rectangular-shaped frame of the inner upright wall structure of the base to the supporting platform or bottom wall of the base of the vault;

FIG. 12 is an enlarged fragmentary sectional detail view of the area encircled in FIG. 9, illustrating the means or construction for securing the closure plate or lid member of the base of the vault to the generally rectangular-shaped frame of the inner upright wall structure of the base of the vault, in position to close the open top thereof, and the means or construction for hermetically sealing the closure plate or lid member to the frame of the upright wall structure of the base at the top thereof;

FIG. 13 is an enlarged fragmentary vertical sectional view, on line 13—13 in FIG. 1, illustrating the arrangement and adhesive mounting of one of the decorative colored geometrically-shaped inserts or panels in one of the correspondingly geometrically-shaped recesses on panel areas which are formed in the outer surfaces of the side walls and end walls of the dome-shaped outer cover member of the vault;

FIG. 14 is an enlarged fragmentary transverse sectional plan view on line 14—14 in FIG. 9, illustrating the construction and arrangement of the reinforcing ribs on the outer surfaces of the side walls of the generally rectangular-shaped open frame of the inner upright wall structure and the reinforcing ribs on the inner surface of the side walls of the dome-shaped outer cover member of the vault;

FIG. 15 is a fragmentary sectional detail view on line 15—15 in FIG. 3, illustrating the hinged mounting of the top or closure member of the "surround" or false casket to the handle-bearing open frame of the "surround" or false casket;

FIG. 16 is a fragmentary vertical sectional view similar, in part, to FIG. 9, on line 16—16 in FIG. 5, illustrating the latching means for releasably latching the "surround" or false casket to the inner upright wall structure and the supporting platform and bottom wall of the base of the vault at the funeral home, and showing the false casket or "surround" arranged over and enclosing the inner open upright wall structure and supporting platform or bottom wall of the base of the vault; and FIG. 17 is an enlarged fragmentary sectional detail view of the area encircled in FIG. 16, and illustrating the latching means embodied in the invention for releasably latching the "surround" or false casket to the inner upright wall structure and supporting platform or bottom wall of the base of the vault.

GENERAL DESCRIPTION OF THE INVENTION AND ITS USE INCLUDING A DESCRIPTION OF THE "SURROUND" OR FALSE CASKET UNIT 76

The new combination burial vault and casket and funeral and burial method or system includes a burial vault, which is generally indicated at 15 in FIGS. 1, 2, 3 and 7 to 17, inclusive, of the drawings, which is disclosed and claimed, per se, in applicant's co-pending application, identified above, and which will be described in detail hereinafter.

The burial vault 15 comprises a base 16 which includes, as components thereof, a generally rectangular-shaped upright open frame of an inner upright wall structure 17; a generally rectangular-shaped flat supporting platform 20 on which the inner wall structure 17 of the base 16 is mounted and which forms the bottom wall of the inner open upright wall structure of the base of the vault; a generally falt rectangular-shaped closure plate or lid member 21 which in use, and after the close of visitation and the funeral service at the funeral home, is arranged over and encloses the open upper end 18 of the upright inner wall structure 17 of the base 16 of the vault 15; and a generally rectangular-shaped dome or cover member 22 which has an open bottom 26 and a closed top 25 and which, after the close of visitation and the funeral service at the funeral home, is arranged over and is hermetically sealed and mechanically fastened to the assembled component parts 17, 20 and 21 of the base 16 of the vault 15 at the funeral home, with the remains of the deceased therein, as will be described more fully hereinafter.

The new funeral and burial method or system includes a novel combination burial vault and casket unit, which is generally indicated at 75 in the drawings (FIGS. 3, 4, 5, 6, 7 and 16) and which includes a "surround" or false casket 76 which includes a generally rectangular-shaped open frame having side walls 77 and end walls 78, an open bottom 79, and an open top 80 which is adapted to be closed in use, after the visitation and the funeral service at the funeral home, by a hinged top or closure member 81 which includes an interiorly decorated head section 82 and an interiorly decorated foot section 83, both of which are hingedly connected, at at 84, (FIG. 15), to the rear side wall 77 of the frame of the "surround" or false casket unit 75.

The "surround" or false casket 76 may be made of wood, painted metal, bronze metal, plastic resinous molding material, or other suitable material, and the generally rectangular-shaped open frame thereof is substantially coextensive with the outer dimensions of the side walls 23 and end walls 24 of the upright inner wall structure of the base 16 of the vault 15 so as to enclose the same.

As shown in the drawings, (FIGS. 3, 4, 5, 6 and 7), the side walls 77 of the generally rectangular-shaped open frame 76 of the "surround" or false casket unit 76 are provided with permanently attached handle members, at 85, mounted thereon, and the end walls 78 thereof may also, if desired, be provided with similar handle members 100, to simulate functional carrying handles on a conventional casket, although the only function of the handle members 85 and 100 is to enable the "surround" or false casket 76, with or withoiut the inner upright wall structure 17 releasably latched thereto, to be readily carried and moved in or about the funeral home.

DETAILED DESCRIPTION OF THE CONSTRUCTION OF THE BURIAL VAULT 15 WHICH IS EMBODIED IN THE INVENTION (FIGS. 1, 2, 3 AND 7 TO 17, INCLUSIVE)

Figure 2:
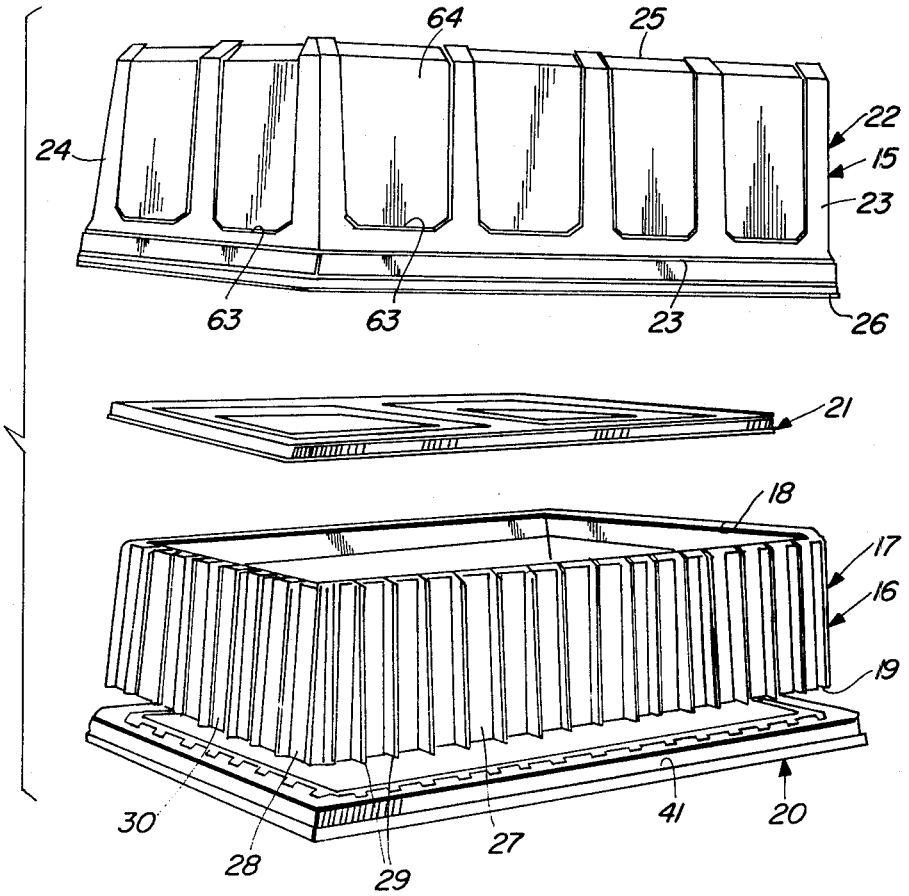
FIG. 2 is an exploded perspective view of the component parts of the burial vault illustrated in FIG. 1.

A typical and preferred embodiment of the burial vault 15 which is embodied in the invention is illustrated in FIGS. 1, 2, 3 and 7 to 17, inclusive, of the drawings, and is shown with the component parts thereof in assembled position in FIG. 1, and with the component parts thereof shown separately in the exploded view, FIG. 2, As shown in FIG. 2, the burial vault 15 includes a composite base 16 which is composed, in general, of three component parts, namely, (1) an inner upright wall structure 17 having a generally rectangular-shaped box-like frame which has an open top 18, an open bottom 19, generally vertically extending side walls 27 and end walls 28, respectively; (2) a generally rectangular-shaped supporting platform 20 on which the generally rectangular-shaped open frame of the inner upright wall structure 17 is supported when the parts are in assembled position, and which forms the bottom wall of the inner wall structure 17 of the base of the vault; (3) a generally rectangular-shaped flat closure plate or lid member 21 which, after the close of visitation and the funeral services at the funeral home, is arranged over and closes the open top 18 of the generally rectangular-shaped open frame of the inner upright wall structure 17 of the base 16 of the vault 15 when the parts of the vault 15 are in assembled position, as in FIGS. 1 and 7 to 17, inclusive, and with the remains of the deceased therein to be transported to the cemtery for a graveside or other cemetery service.

The burial vault 15 also includes a dome-shaped outer cover member, which is generally indicated at 22, and which is generally rectangular-shaped in form, and includes side walls 23; end walls 24; a closed and generally flat top wall 25; and an open bottom 26.

All of the four major component parts 17, 20, 21 and 22 of the burial vault 15 are preferably molded from suitable synthetic plastic molding material such for example, as polyethylene resin, or other suitable molding resin, but may, if desired, be made of other suitable material, including metal, or the like.

As shown in FIG. 2, the side walls 27 and end walls 28 of the generally rectangular-shaped and box-like frame of the inner upright walls structure 17 of the vault 15 have generally parallel and generally vertically extending spaced reinforcing ribs 29 and 30, respectively, formed integrally therewith on the outer surfaces thereof.

Similarly, each of the side walls 23 and end walls 24 of the dome-shaped outer cover member 22 has a series of generally vertically extending parallel spaced reinforcing ribs 31 and 32, respectively, formed integrally therewith on their inner surfaces (FIGS. 8, 9, 10, 12, 14 and 17).

As shown in FIG. 14, the reinforcing ribs 29 on the outer surfaces of the side walls 27 of the generally rectangular-shaped open frame of the inner upright wall structure 17 engage the inner surfaces of the side walls 23 of the dome-shaped outer cover member 22 and, similarly, the reinforcing ribs 31 on the inner surfaces of the side walls 23 of the dome-shaped outer cover member 22 engage the outer surfaces of the side walls 27 of the frame of the inner upright wall structure 17.

Similarly, as shown in FIG. 10, the reinforcing ribs 30 on the outer surfaces of the end walls 28 of the frame of the inner upright wall structure 17 of the base 16 of the vault 15 engage the inner surfaces of the end walls 24 of the dome-shaped outer cover member 22 and the reinforcing ribs 32 on the inner surfaces of the end walls 24 of the dome-shaped outer cover member 22 engage the outer surfaces of the end walls 28 of the frame of the inner upright wall structure 17. This arrangement of the reinforcing ribs 29, 30, 31 and 32, in relation to the frame of the inner upright wall structure 17 and the dome-shaped outer cover member 22, greatly enhances the structural strength of these parts and of the burial vault 15, in general, when the parts thereof are in assembled position and the vault is interred in the grave opening.

THE MEANS FOR HERMETICALLY SEALING AND MECHANICALLY SECURING THE CLOSURE PLATE OR LID MEMBER 21 TO THE TOP OF THE GENERALLY RECTANGULAR-SHAPED OPEN FRAME OF THE INNER UPRIGHT WALL STRUCTURE 17 (FIG. 12)

As shown in FIG. 12 of the drawings, the side walls 27 of the generally rectangular-shaped frame of the open inner upright wall structure 17 of the base 16 of the vault 15 have a marginal or peripheral supporting flange 33 formed integrally therewith on the upper end portions thereof and this marginal or peripheral supporting flange 33 projects laterally and generally horizontally inwardly from the side walls 27 of the frame of the inner upright wall structure 17; a similar construction (not shown) being provided on the end walls 28 of the generally rectangular-shaped open frame of the inner upright wall structure 17 of the base 16.

As also best shown in FIG. 12, the generally rectangular-shaped closure plate or lid member 21 has an upwardly extending and generally inverted U-shaped marginal or peripheral flange member 34 formed integrally therewith, and extending around its marginal or peripheral edges, and a downwardly facing groove 35 is formed in the inverted U-shaped flange member 34. The upper marginal edge portions, as 36, of the side walls 27 and end walls 28 of the frame of the inner upright wall structure 17 extend into the groove 35, thus providing a tongue and groove supporting construction 34-35-36 between the upper marginal edge portions, as 36, of the side walls 27 and end walls 28 of the frame of the inner upright wall structure 17 and the generally rectangular-shaped closure plate or lid member 21, so that the closure plate or lid member 21 rests on and is secured to the upper marginal edge portions, as 36, of the side walls 27 and end walls 28 of the inner upright wall structure 27, as best shown in FIG. 12.

As is also shown in FIG. 12, a layer of sealing tape or other suitable and conventional plastic sealant material 37 is arranged upon and over the upper surface of the inwardly extending marginal or peripheral flange 33 and the outer marginal or peripheral edge portions of the closure plate or lid member 21 rest on the layer of tape or other plastic sealant material 37, thereby providing an hermetic water-resistant seal between the frame of the inner upright wall structure 17 and the closure plate or lid member 21 when the parts are in assembled position, as in FIG. 12, and when the vault 15 is interred in the grave opening.

As is shown in FIGS. 8, 9 and 12 of the drawings, each of the internal reinforcing ribs 31 and 32 on the inner surfaces of the side walls 23 and end walls 24, respectively, of the dome-shaped outer cover member 22 includes an upper portion having a notched section which provides a generally horizontally extending shoulder 38 formed therein in the upper area therof, and in the assembly of the component parts of the burial vault 15 these shoulders 38 rest on the upper surface of the marginal or peripheral flange 34 of the closure plate or lid member 21, as best shown in FIG. 12.

THE MEANS FOR HERMETICALLY SEALING AND THE MEANS FOR MECHANICALLY FASTENING THE GENERALLY RECTANGULAR-SHAPED FRAME OF THE INNER UPRIGHT WALL STRUCTURE 17 TO THE SUPPORTING PLATFORM AND BOTTOM WALL 20 OF THE VAULT 15 (FIG. 11)

As shown in FIGS. 8 and 9, the body of the supporting platform 20, which provides the bottom wall of the inner upright wall structure 17 of the vault 15, has a series of generally parallel and laterally spaced and transversely extending reinforcing and supporting ribs or feet 39 formed integrally therewith on the bottom surface thereof and extending transversely and downwardly from the supporting platform or bottom wall 20 of the vault 15 between the inner marginal or peripheral side and end walls supporting structure 40 of the supporting platform or bottom wall 20 of the vault 15, as will be described hereinafter.

As shown in FIGS. 9, 11 and 17, the inner marginal or peripheral side and end wall supporting structure 40 has an enlarged and generally U-shaped upper end or head portion 85 formed thereon and an upwardly facing sealing groove 43 is formed therein. As is also shown in FIG. 11, each of the side walls 27 and end walls 28 of the frame of the inner upright wall structure 17 of the base 16 of the vault 15 has a downwardly extending lower end portion, in the form of a sealing tongue 44, formed thereon which projects into the sealing groove 43, thereby providing a tongue and groove sealing construction 44–43 between the side walls 27 and end walls 28 of the frame of the inner upright wall structure 17 and the inner supporting wall structure 40 of the supporting platform or bottom wall 20 of the vault 15, To complete this sealing construction, a suitable and conventional plastic sealant tape or other sealant material 45 is arranged in the sealing groove 43 to provide an heremetic water-resistant seal between the sealing groove 43 and the sealing tongue 44 (FIGS. 11 and 17).

The marginal or peripheral inner side wall and end wall supporting structure 40 of the supporting platform or bottom wall 20 of the vault 15 has an outwardly and generally horizontally extending flange member 46 formed thereon, and the flange member 46 extends laterally outwardly somewhat below the body of the supporting platform or bottom wall 20 of the vault 15, as shown in FIGS. 11 and 17.

The flange member 46 has a laterally outwardly and downwardly extending flange portion 47 which is curved outwardly and downwardly and merges into and is integral with the upper edge portions of an outer marginal or peripheral side and end wall supporting wall structure 41 of the supporting platform or bottom wall 20 of the vault 15, as shown in FIGS. 8, 9, 16 and 17.

An outwardly and generally horizontally extending flange member 48 is formed on and integrally with the lower end portion of each of the side walls 27 and end walls 28 of the frame of the inner upright wall structure 17, and fastening elements in the form of headed screws 49 are extended through openings 50 in the flange member 46 and into threaded openings 51 in the flange member 48, thereby mechanically fastening the frame of the inner upright wall structure 17 of the base 16 to the supporting platform or bottom wall 20 of the vault 15. As shown in FIGS. 11 and 17, a suitable and conventional plastic sealant material 52 is arranged between the flange members 46 and 48 to provide an hermetic water-resistant seal between these parts.

THE MEANS FOR HERMETICALLY SEALING AND THE MEANS FOR MECHANICALLY FASTENING THE DOME-SHAPED OUTER COVER MEMBER 22 TO THE SUPPORTING PLATFORM OR BOTTOM WALL 20 OF THE VAULT 15 (FIG. 11)

The downwardly extending and curved flange portion 47 of the flange member 46 has an upwardly and vertically extending marginal or peripheral supporting rib 53 formed integrally therewith, adjacent its outer marginal or peripheral edge portion, and this supporting rib 53 cooperates with the flanges 46-47 and 48 to provide a sealing groove 61 into which a downwardly extending sealing tongue 54 on the side walls 23 and end walls 24 of the dome-shaped outer cover member 22 projects, thereby providing a tongue and groove sealing construction 54–61 between the dome-shaped outer cover member 22 and the outer marginal or peripheral supporting wall structure 41 of the supporting platform or bottom wall 20, of the vault 15, this sealing construction being completed by a suitable and conventional plastic sealant material 55 which is arranged in the sealing groove 61 to provide an hermetic water-resistant seal therein.

The upwardly extending supporting rib 53 on the flange portion 47 projects into a marginal or peripheral groove 56 which is formed in an outwardly extending flange 57 which is formed on each of the side walls 23 and end walls 24 of the dome-shaped outer cover member 22 so that the dome-shaped outer cover member 22 rests, in part, on the supporting ribs 53 (FIG. 11).

The dome-shaped outer cover member 22 is mechanically fastened to the outer supporting wall structure 41 of the supporting platform 20 by means of fastening elements in the form of headed screws 58 which are extended, at a downwardly inclined angle, through openings 59 which are formed in a tapered shoulder 62 which is formed in the side walls 23 and end walls 24 of the dome-shaped outer cover 22 and into threaded openings 60 which are formed in the outer marginal or peripheral supporting wall structure 41 of the supporting platform or bottom wall 20 of the vault 15 (FIG. 11), and in this manner the dome-shaped outer cover member 22 is hermetically sealed and mechanically fastened to the outer marginal or peripheral supporting wall structure 41 of the supporting platform or bottom wall 20 of the vault 15.

As shown in FIG. 3, the inner wall surfaces of the side walls 27 and end walls 28 of the inner upright wall structure 17 of the base 16 of the vault 15 are provided at the funeral home with conventional casket decorative material 88 and, similarly, the inner surface of the hinged top or closure member 81 of the surround or false casket 76 is provided with conventional casket decorative material 89.

THE DECORATIVE COLORED PANELS ON THE OUTER SURFACES OF THE SIDE AND END WALLS 23 AND 24, RESPECTIVELY, OF THE DOME-SHAPED OUTER COVER MEMBER 22 (FIGS. 1 AND 13)

The burial vault 15 comprises an arrangement of decorative geometrically-shaped colored panels which are adhesively mounted in correspondingly geometrically-shaped recesses in the outer surfaces of the side walls 23 and end walls 24, respectively, of the dome-shaped outer cover member 22. This construction and arrangement are provided by suitably geometrically-shaped recesses 63 which are formed in the outer surfaces of the side and end walls 23 and 24, respectively, of the dome-shaped outer cover member 22 and into which correspondingly geometrically-shaped colored panels 64 are arranged and are held in the recesses 63 by means of a suitable adhesive (FIG. 13), thus enhancing the decorative, ornamental and aesthetic appearance and appeal of the burial vault 15. The decorative colored panels 64 may be made of suitably colored molded plastic resinous material, colored or decorative paper, or light metal, such as permanently colored aluminum, or the like.

THE MEANS FOR RELEASABLY LATCHING THE "SURROUND" OR FALSE CASKET 75 OVER AND TO THE INNER UPRIGHT WALL STRUCTURE OF THE BASE 16 (FIG. 17)

The new combination burial vault and casekt and funeral and burial vault method or system 75 includes novel latching means for releasably latching the "surround" or false casket 76 over and to the inner upright wall structure 17 of the base 16 of the vault 15 at the funeral home so that if and when necessary, the casket assembly of the "surround" or false casket 76 and the inner upright wall structure 17 of the base of the vault 15, with or without the remains of the deceased therein, may be carried by the handle members 85 on the "surround" or false casket 76 in or about the funeral home, or like place. However, after the close of the funeral service at the funeral home the "surround" or false casket 76 may be unlatched from the inner upright wall structure 17 and the supporting platform or bottom wall 20 of the vault 15 and retained at the funeral home for reuse.

This novel latching means is illustrated in FIGS. 16 and 17, wherein it is generally indicated at 86. One of such latching devices 86 is arranged at or adjacent to each of the four corners of the side walls 77 and end walls 78 of the "surround" or false casket 76, although only one of such latching devices 86 will now be described in detail, since they are all similar in construction. Thus, as shown in FIG. 17, each of the latching devices 86 comprises a generally cylindrical latching pin 90 which is slidably mounted in a latching opening 91 which is formed in the lower corner portion 92 of the side wall 77 of the "surround" or false casket 76. The latching pin 90 includes an inner end portion 93 which is slidably mounted in a latching opening 95 which is formed in the lower end portion of the marginal or peripheral supporting wall structure 41 of the base 16 of the vault 15, as shown in FIG. 17. The latching pin 90 has an annular shoulder 96 formed thereon, between the inner and outer ends, and this shoulder 96 is disposed in a cavity 97 which is formed in the lower end portion 92 of the side wall 77 of the "surround" or false casket 76. A coil spring member 98 is mounted on the latching pin 90, within the cavity 97, and its inner end convolution bears against the annular shoulder 96 of the latching pin 90 and its outer end convolution bears against the outer wall portion 99 of the side wall 77 of the "surround" or false casket 76 (FIG. 17).

In the use of the latching device 86, the "surround" or false casket 76 is releasably latched to the inner wall structure 17 of the base 16 of the vault 15 properly aligning the "surround" or false casket 76 with and over the assembled inner upright wall structure 17 and the supporting platform or bottom wall 20 of the inner upright wall structure 17, and manually retracting the latching pins 90, against the action of the coil springs 98, into their outwardly extended position, as in dotted lines in FIG. 17, while positioning the parts so that the latching pins 90 on the inner upright wall structure 17 of the base 16 of the vault 15 are properly aligned and in registation with the latching openings 95 in the marginal or peripheral supporting wall structure 41, respectively, as shown in FIGS. 16 and 17. When the parts are so positioned the inner end portions 93 of the latching pins 90 are urged by the coil springs 98 into the latching openings 95 which are formed in the inner marginal or peripheral supporting wall structure 41 of the base 16 of the vault 15, thereby releasably latching the "surround" or false casket 76 to the inner upright wall structure 17 and it supporting platform or bottom wall 20.

At the close of visitation and the funeral service at the funeral home, the "surround" or false casket is be unlatched from the base 16 of the vault 15 by manually withdrawing and unlatching the four (4) corner latching pins 90 from full to dotted line position, as shown in FIG. 17, against the action of the coil springs 98, thereby withdrawing the inner end portions 93 of the latching pins 90 from the latching openings 95 in the inner marginal or peripheral supporting wall structure 41 of the base 16 of the vault 15, so that the "surround" or false casket 76 may be lifted off the inner wall structure 17 and its supporting platform or bottom wall 20 and retained at the funeral home for reuse.

OPERATION AND USE OF THE NEW COMBINATION BURIAL VAULT AND CASKET AND FUNERAL AND BURIAL METHOD OR SYSTEM

In the use of the new combination burial vault and casket and the new funeral and burial method or system, the generally rectangular-shaped frame of the inner wall structure 17 of the base of the vault 15 is arranged over and is hermetically sealed to and mechanically fastened to the generally rectangular-shaped flat supporting platform or bottom wall 20 of the base of the vault 15, at the funeral home, by means of the hermetic sealing and mechanical fastening means shown in FIG. 11 of the drawings, and as described hereinbefore.

For the purpose of visitation and the funeral service at the funeral home, the open generally rectangular-shaped frame of the "surround" or false casket 76 is arranged over the inner wall structure 17 of the base 16, and its supporting platform or bottom wall 20, as shown in FIG. 4, and is releasably latched to the inner upright wall structure 17 of the base 16 of the vault 15 by means of the latching means 86, as best shown in FIG. 17 of the drawings, and as described hereinbefore.

The thus assembled inner wall structure 17 and the generally rectangular-shaped flat supporting platform or bottom wall 20 of the base 16 of the vault 15 and the "surround" or false casket unit 76 may then be mounted for viewing at the funeral home on a suitable and conventional supporting frame, which is generally indicated at 87, and as shown in FIG. 4 of the drawings, with the remains of the deceased arranged in the casket assembly which is formed by the cooperation of the inner upright wall structure 17 of the base 16 and the supporting platform or bottom wall 20 of the vault 15, and the "surround" or false casket 76 enclosing the same, for visitation and the funeral services at the funeral home.

During the visitation and the funeral service at the funeral home, the interiorly decorated foot section 83 of the top or closure member 81 of the "surround" or false casket unit 76 is normally disposed in closed position, and the head section 82 thereof is disposed in open position for viewing, as shown in FIG. 4 of the drawings.

After the close of the visitation and the funeral service at the funeral home, the hinged head section 82 of the top or closure member 81 of the "surround" or false casket 76 is closed and the "surround" or false casket 76 is unlatched from and removed from the inner upright wall structure 17 of the base 16 and its supporting platform or bottom wall 20 and retained at the funeral home for reuse, whereupon the closure plate or lid member 21 is arranged over the assembly of the upright inner wall structure 17 of the supporting platform or bottom wall 20 of the base 16 of the vault 15 and is hermetically sealed thereto, as shown in FIG. 12, and as described hereinbefore. The dome-shaped cover member 22 is then arranged over and is hermetically sealed and mechanically fastened to the inner upright wall structure 17 and its supporting platform or bottom wall 20, as shown in FIG. 11, and as hereinbefore described.

The thus assembled and sealed vault 15, with the remains of the deceased enclosed therein, may then be moved or transported on a conventional casket bier, or other suitable means, from the funeral home to the hearse and from the hearse to the graveside for a graveside, or other cemetery service.

The thus assembled and sealed component parts of the burial vault 15, with the remains of the deceased enclosed therein, may then be interred in the grave opening.

It will thus be seen from the foregoing description, considered in conjunctin with the accompanying drawings, that the present invention provides a novel combination burial vault and casket and a novel funeral and burial system or method employing the same, and thus has the desirable advantages and characteristics and accomplishes its intended objects including those hereinbefore pointed out and others which are inherent in the invention.

I claim:

1. A combination burial vault and casket comprising:

(a) a burial vault comprising
  (1) a base including
    a. a generally rectangular-shaped flat supporting platform which supports the bottom wall of the base of the vault;
    b. a generally rectangular-shaped box-like upright inner wall structure mounted on and attached to the said supporting platform and including
      (1) side walls; and
      (2) end walls; and having
        (a) an open top; and
        (b) an open bottom which is closed by the said supporting platform or bottom wall of the base of the vault;

(b) a "surround" or false casket including
  (1) a generally rectangular-shaped open frame including
    a. front and rear side walls; and
    b. end walls; and having
      (1) an open top; and
      (2) an open bottom; and
  (2) a top or closure member hingedly connected to the said rear side wall of the said generally rectangular-shaped open frame of the said "surround" or false casket;

(c) the said generally rectangular-shaped open frame of the said "surround" or false casket being arranged over and enclosing the said upright inner wall structure of the said base and its supporting platform or bottom wall;

(d) the "surround" or false casket and the said inner upright wall structure of the said base and the said supporting platform or bottom wall cooperating to provide a casket assembly in which the remains of the deceased are rested during visitation and the funeral service at the funeral home;

(e) latching means for releasably latching the said generally rectangular-shaped open frame of the said "surround" or false casket to the said upright inner wall structure and the said supporting platform of the said base;

(f) a closure lid member adapted to be arranged over and to close the said open top of the said upright inner wall structure of the said base to close the same after the close of visitation and the funeral services at the funeral home;

(g) means for hermetically sealing the said closure lid member over the said open top of and to the said upright inner wall structure of the said base of the vault;

(h) the said "surround" or false casket being adapted to be unlatched by the said latching means from the said upright inner wall structure and its aforesaid supporting platform or bottom wall after the close of visitation and the funeral service at the funeral home and retained at the funeral home for reuse;

(i) a dome-shaped member adapted to be arranged over and to enclose the said upright inner wall structure of the said base and its aforesaid supporting platform or bottom wall after removal of the said "surround" or false casket from the said upright inner wall structure and its aforesaid supporting platform or bottom wall at the funeral home;

(j) means for hermetically sealing the said dome-shaped cover member to the said upright inner wall structure and its aforesaid supporting platform or bottom wall; and (k) means for mechanically fastening the said dome-shaped cover member to the said upright inner wall structure and its aforesaid supporting platform or bottom wall.

2. A combination burial vault and casket as defined in claim 1 in which the said top or closure member of the said "surround" or false casket includes (a) a foot section; and (b) a head section; and in which (c) both the said foot section and the said head section of the said top or closure member are hingedly mounted on the said rear side wall of the said generally rectangular-shaped open frame of the said "surround" or false casket but are separately hingedly movable thereon into and from open and closed positions.

3. A combination burial vault and casket as defined in claim 1 in which the said upright inner wall structure of the said base of the said vault and the said top or closure member of the said "surround" or false casket have (a) interior surfaces; and in which (b) the said interior surfaces of the said inner wall structure of the said upright inner wall structure of the said base and of the said top or closure member of the said "surround" or false casket have (1) decorative casket upholstery material arranged thereon to simulate the appearance of a conventional burial casket.

4. A combination burial vault and casket as defined in claim 1 in which (a) the said front and rear side walls of the said "surround" or false casket have (1) handle means thereon.

5. A combination burial vault and casket as defined in claim 1 in which (a) the said "surround" or false casket has (1) corner portions arranged adjacent the intersection of the said front and rear side walls and the said end walls thereof; and in which (b) the said latching means includes (1) a latching device arranged adjacent to each of the said corner portions of the said "surround" or false casket for releasably latching the said "surround" or false casket to the said upright inner wall structure and its aforesaid supporting platform or bottom wall.

6. A combination burial vault and casket comprising:

(a) a base including (1) a generally rectangular-shaped open box-like frame including a. an inner upright wall structure including (1) side walls; and (2) end walls; and having (a) a closed bottom wall which provides a supporting platform for the said inner upright wall structure of the base of the vault; and (b) an open top;

(2) a "surround" or false casket including a. a generally rectangular-shaped open frame having (1) front and rear side walls; and (2) end walls; and having (a) an open top; and (b) a top or closure member hingedly mounted on the said rear side wall of the said generally rectangular-shaped open frame of the said "surround" or false casket;

(3) the said "surround" or false casket being adapted to be arranged over and to enclose the said inner upright wall structure and its aforesaid bottom wall and supporting platform and cooperating with the said inner upright wall structure and its aforesaid bottom wall and supporting platform to provide a casket assembly in which the remains of the deceased may be arranged for visitation at the funeral home or like place;

(4) means for releasably latching the said "surround" or false casket to the said inner upright wall structure and its aforesaid bottom wall and supporting platform to enable the said "surround" or false casket and the said inner upright wall structure and its aforesaid bottom wall and supporting platform to be moved in or about the funeral home or like place;

(5) the said "surround" or false casket being adapted to be unlatched from the said inner upright wall structure and its aforesaid bottom wall and supporting platform after the close of the visitation and the funeral service at the funeral home and retained at the funeral home for reuse; and (6) a dome-shaped cover member adapted to be arranged over the said inner upright wall structure and its aforesaid bottom wall and supporting platform and to be hermetically sealed and mechanically fastened at the funeral home to the said inner upright wall structure and its aforesaid bottom wall and supporting platform after the said "surround" or false casket has been unlatched from the said upright inner wall structure and its aforesaid bottom wall and supporting platform at the funeral home.

7. A combination burial vault and casket as defined in claim 6 which includes (a) handle means on the said side walls of the said "surround" or false casket.

8. A combination burial vault and casket comprising:

(a) a burial vault including (1) a generally rectangular-shaped box-like wall structure adapted to have the remains of the deceased laid therein for visitation at a funeral home or like place; and having a. front and rear side walls;

b. end walls;

c. a closed bottom wall; and d. an open top;

(2) a "surround" or false casket adapted to be removably mounted on the said generally rectangular-shaped box-like wall structure of the said base and including a. a generally rectangular-shaped open frame which is generally codimensional with and adapted to enclose the said side and end walls of the said interiorly decorated generally rectangular-shaped box-like wall structure outwardly thereof and having (1) front and rear side walls;

(2) end walls;

(3) an open bottom; and (4) an open top; and having (5) a top or closure member hingedly mounted on the said rear side wall of the said generally rectangular-shaped frame of the said "surround" or false casket and adapted to close the said open top thereof but movable from closed to open position for viewing during visitation and the funeral service at the funeral home or like place;

(3) closure means for closing the said open top of the said generally rectangular-shaped box-like wall structure of the said burial vault after removal of the said "surround" or false casket therefrom; and (4) a dome-shaped cover member adapted to be arranged over and to enclose the said generally rectangular-shaped box-like wall structure of the said burial vault and the said closure means after removal of the said "surround" or false casket therefrom.

9. A combination burial vault and casket as defined in claim 8 which includes (a) means for securing the said closure means to be said generally rectangular-shaped box-like wall structure of the said vault;

(b) means for hermetically sealing the said closure means to the said side walls and end walls of the said generally rectangular-shaped box-like wall structure of the said burial vault;

(c) means for hermetically sealing the said dome-shaped cover member to the said generally rectangular-shaped box-like wall structure of the said vault; and (d) means for mechanically fastening the said dome-shaped cover member to the said generally rectantular-shaped box-like wall structure of the said burial vault.

10. A combination burial vault and casket as defined in claim 9 which includes (a) means for releasably latching the said "surround" or false casket to the said generally rectangular-shaped box-like wall structure of the said burial vault.

11. A combination burial vault and casket as defined in claim 8 in which (a) the said top or closure member of the said "surround" or false casket includes (1) a head section; and (2) a foot section; and in which the said top or closure member of the said "surround" or false casket has a. an inner surface; and in which b. decorative casket material is arranged on the said inner surface thereof.

12. A combination burial vault and casket as defined in claim 11 in which (a) the said side walls and end walls of the said generally rectangular-shaped box-like wall structure of the said burial vault have (1) inner surfaces; and in which (b) the said inner surfaces of the said side walls and end walls of the said generally rectangular-shaped box-like wall structure of the said burial vault have (1) decorative casket material arranged on the said inner surfaces thereof.

13. A combination burial vault and casket as defined in claim 8 in which (a) the said front and rear side walls of the said "surround" or false casket have (1) handle means mounted thereon.

14. A funeral and burial method or system which employs a burial vault which comprises a base including a generally rectangular-shaped upright inner wall structure including side walls and end walls and having an open top and an open bottom and a generally rectangular-shaped flat supporting platform for the said inner wall structure which provides the bottom wall of the said upright inner wall structure and on which the said upright inner wall structure is supported; a dome-shaped cover member for the said upright inner wall structure of the said base including side walls and end walls and having an open bottom and a closed top wall; and a "surround" or false casket which includes a generally rectangular-shaped open frame which is substantially dimensionally coextensive with and is adapted to enclose the said side walls and end walls of the said upright inner wall structure of the said base of the vault and has a top or closure member mounted on and hingedly connected to the said generally rectangular-shaped open frame of the said "surround" or false casket; the said funeral and burial method or system comprising the steps of:

(a) mounting the said upright inner wall structure of the said base of the said burial vault on and fastening it to the said bottom wall and supporting platform therefor in a funeral home or like place;

(b) assembling the said generally rectangular-shaped open frame of the said "surround" or false casket and its aforesaid top or closure member over the said open top of the said upright inner wall structure of the said base of the vault so that the said generally rectangular-shaped frame of the said "surround" or false casket encloses the said generally rectangular-shaped open frame of the said upright inner wall structure of the said base of the vault and its aforesaid bottom wall and supporting platform and cooperates therewith to provide a casket assembly in which the remains of the deceased are disposed for viewing during visitation and the funeral service at the funeral home, or like place;

(c) releasably latching the said generally rectangular-shaped open frame of the said "surround" or false casket to the said upright inner wall structure and its aforesaid bottom wall and supporting platform;

(d) unlatching the said "surround" or false casket from the said upright inner wall structure and its aforesaid bottom wall and supporting platform after the close of visitation and the funeral service at the funeral home and retaining the said "surround" or false casket at the funeral home for reuse;

(e) arranging the dome-shaped cover member over the said upright inner wall structure and its aforesaid bottom wall and supporting platform after the said "surround" or false casket has been unlatched and removed therefrom;

(f) hermetically sealing the said dome-shaped cover member of the said burial vault to the said upright inner wall structure and its aforesaid bottom wall and supporting platform;

(g) mechanically fastening the said dome-shaped cover member of the said vault to the said upright inner wall structure and its aforesaid bottom wall and said supporting platform; and (h) interring the said burial vault with the remains of the deceased therein in the grave opening.

15. A funeral and burial method or system as defined in claim 14 in which the said upright inner wall structure of the said base and the said hinged top or closure member of the said "surround" or false casket have interior surfaces and in which the said funeral and burial method or system includes the steps of (a) providing decorative casket upholstery material on the said interior surfaces of the said inner upright wall structure of the said base and on the interior surface of the said hinged top or closure member of the said "surround" or false casket for viewing during visitation at the funeral home.

16. A funeral and burial method or system as defined in claim 14 which includes the steps of (a) arranging a generally flat rectangular-shaped closure or lid member over the said open top of the said upright inner wall structure of the said base after removal of the said "surround" or false casket therefrom; and (b) hermetically sealing the said generally rectangular-shaped closure or lid member to the said upright inner wall structure of the said base prior to interment to close the said open top of the said inner upright wall structure of the said base with the remains of the deceased therein.

17. A funeral and burial method or system which employs a burial vault which includes a base having generally rectangular-shaped and box-like upright inner wall structures, having side walls and end walls having inner surfaces provided with decorative casket material, an open top and a closed bottom wall providing a supporting platform for the said base of the vault, a closure plate or lid member for closing the said open top of the said upright inner wall structure, a dome-shaped cover member for enclosing the said upright inner wall structure and the said closure plate or lid member, and a "surround" or false casket which includes a generally rectangular-shaped open frame having front and rear side walls and a top or closure member including a foot section and a head section hingedly connected to the said rear side wall of the said generally rectangular-shaped open frame of the said "surround" or false casket and having inner surfaces provided with decorative casket material; the said funeral and burial method or system including the steps of:

(a) mounting the said generally rectangular-shaped and box-like upright inner wall structure of the base of the vault on a suitable support at a funeral home, with the remains of the deceased rested therein for viewing during visitation and the funeral service at the funeral home;

(b) removably mounting the said "surround" or false casket in a position over and enclosing the said generally rectangular-shaped box-like upright inner wall structure and outwardly of the said side walls and end walls thereof with the said foot section of the said closure member of the said "surround" or false casket arranged in closed position and the said head section thereof arranged in open position for viewing during visitation at the funeral home;

(c) closing the said head section of the "surround" or false casket at the close of visitation at the funeral home;

(d) removing the said "surround" or false casket from the said generally rectangular-shaped and box-like upright inner wall structure of the said base after the close of visitation and the funeral service at the funeral home and retaining the said "surround" or false casket at the funeral home for reuse;

(e) arranging the said dome-shaped cover member over and in a position to enclose the said generally rectangular-shaped and box-like inner upright wall structure and supporting platform of the said base;

(f) hermetically sealing and mechanically fastening the said dome-shaped cover member to the said generally rectangular-shaped and box-like upright inner wall structure and supporting platform of the said base after the said "surround" or false casket has been removed therefrom; and (g) transporting the thus assembled and sealed burial vault, with the remains of the deceased therein, from the funeral home to the cemetery for a graveside or other funeral service and for interment in the grave opening.

18. A funeral and burial method or system as defined in claim 17 which includes the steps of (a) releasably latching the said "surround" or false casket to the said rectangular-shaped box-like inner wall structure and supporting platform of the said base at the funeral home; and (b) unlatching the said "surround" or false casket from the said rectangular-shaped box-like inner wall structure and supporting platform of the said base after the close of the visitation and the funeral service at the funeral home.

19. A funeral and burial method or system which includes the use of a burial vault which includes a base having a generally rectangular-shaped box-like wall structure having interiorly decorated front and rear side walls and end walls, a closed bottom wall which provides a supporting platform for the said base of the vault, and an open top which is adapted to have the remains of the deceased arranged therein for viewing at the funeral home, or like place; a "surround" or false casket which includes a generally rectangular-shaped open frame which is generally codimensional with and is adapted to enclose the said generally rectangular-shaped box-like wall structure of the said base of the burial vault and is adapted to be removably mounted thereon and includes side walls and end walls and an open bottom and an open top, and having an interiorly decorated top or closure member hingedly mounted on the said rear side wall thereof, the said burial vault incuding closure means adapted to be secured to the side walls and end walls of the said generally rectangular-shaped box-like wall structure for closing the said open top thereof after removal of the said "surround" or false casket therefrom; the said burial vault including a dome-shaped cover member adapted to be arranged over and to enclose the said generally rectangular-shaped box-like wall structure and the said bottom wall and supporting platform of the base of the vault, and the said closure means therefor with the remains of the deceased disposed therein; the said funeral and burial method or system including the steps of:

(a) arranging the said generally rectangular-shaped box-like wall structure of the said burial vault on a suitable supporting at a funeral home or like place with the remains of the deceased disposed therein for viewing during visitation at the funeral home;

(b) removably mounting the said "surround" or false casket over and in position to enclose the said generally rectangular-shaped box-like wall structure of the base of the vault for viewing and during visitation and the funeral service at the funeral home, or like place;

(c) removing the said "surround" or false casket from the said generally rectangular-shaped box-like wall structure of the base of the said burial vault after visitation and the close of the funeral service at the funeral home, or like place, and retaining the said "surround" or false casket at the funeral home for reuse;

(d) securing the said closure means on the said side walls and end walls of the said generally rectangular-shaped box-like wall structure of the said burial vault to close the said open top thereof; and (e) mounting the said dome-shaped cover member over the said generally rectangular-shaped box-like wall structure and the said bottom wall and supporting platform therefor outwardly of the said side walls and end walls thereof and so as to enclose the said generally rectangular-shaped box-like wall structure of the base with the remains of the deceased therein.

20. A funeral and burial method or system as defined in claim 19 which includes the steps of (a) hermetically sealing the said closure means to the said side walls and end walls of the said generally rectangular-shaped box-like wall structure of the base of the said burial vault so as to close and hermetically seal the said open top thereof after removal of the said "surround" or false casket therefrom;

(b) hermetically sealing the said dome-shaped cover member to the said generally rectangular-shaped box-like wall structure of the said burial vault; and (c) mechanically fastening the said dome-shaped cover member to the said generally rectangular-shaped box-like wall structure of the said burial vault with the remains of the deceased therein for transportation from the funeral home to the cemetery for a graveside or other cemetery service.

21. A funeral and burial method or system as defined in claim 19 which includes the step of (a) releasably latching the said "surround" or false casket to the said generally rectangular-shaped box-like wall structure of the said base of the burial vault during visitation and the funeral service at the funeral home.

22. A funeral and burial method or system as defined in claim 21 which includes the step of (a) unlatching the "surround" or false casket from the said generally rectangular-shaped box-like wall structure of the base of the said burial vault after the close of visitation and the funeral service at the funeral home and retaining the said "surround" or false casket at the funeral home for reuse.

* * * * *